US012539449B2

(12) United States Patent
Engle et al.

(10) Patent No.: US 12,539,449 B2
(45) Date of Patent: Feb. 3, 2026

(54) GOLF BALL HAVING NON-SPHERICAL DIMPLES

(71) Applicant: Acushnet Company, Fairhaven, MA (US)

(72) Inventors: Courtney N. Engle, Fall River, MA (US); Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 176 days.

(21) Appl. No.: 18/442,469

(22) Filed: Feb. 15, 2024

(65) Prior Publication Data

US 2024/0181298 A1 Jun. 6, 2024

Related U.S. Application Data

(63) Continuation-in-part of application No. 18/192,284, filed on Mar. 29, 2023, now Pat. No. 11,904,210, which is a continuation of application No. 17/538,060, filed on Nov. 30, 2021, now Pat. No. 11,617,923.

(51) Int. Cl.
*A63B 37/06* (2006.01)
*A63B 37/00* (2006.01)

(52) U.S. Cl.
CPC ..... *A63B 37/0012* (2013.01); *A63B 37/0009* (2013.01)

(58) Field of Classification Search
CPC ..... A63B 37/0007; A63B 37/0012
See application file for complete search history.

(56) References Cited

U.S. PATENT DOCUMENTS 6,475,105 B1 * 11/2002 Murphy ..... A63B 37/002 473/378
2023/0133455 A1 * 5/2023 Madson ..... A63B 37/0012 473/378

* cited by examiner

*Primary Examiner* — Raeann Gorden
(74) *Attorney, Agent, or Firm* — Steven Landolfi, Jr.

(57) ABSTRACT

A golf ball has a generally spherical surface and a plurality of dimples separated by a land area formed on the surface. The plurality of dimples includes a plurality of non-spherical dimples each having a non-axially symmetric plan shape, a varying edge angle, and a geometric centroid of the non-axially symmetric plan shape (GC). Each dimple cross-section of each non-spherical dimple consists of two arcs, each arc extending from a defined point of maximum dimple depth to a point at the land area of the golf ball. Each non-spherical dimple is oriented at an orientation angle, α, relative to a reference line. The orientation angle α is dependent on the position of the GC on the surface of the golf ball.

17 Claims, 16 Drawing Sheets

GOLF BALL HAVING NON-SPHERICAL DIMPLES

CROSS-REFERENCE TO RELATED APPLICATIONS

This application is a continuation-in-part of U.S. patent application Ser. No. 18/192,284, filed Mar. 29, 2023, which is a continuation of U.S. patent application Ser. No. 17/538,060, filed Nov. 30, 2021, now U.S. Pat. No. 11,617,923, both of which are hereby incorporated herein in their entirety.

FIELD OF THE INVENTION

The field of the invention broadly comprises golf balls incorporating improved non-spherical dimples which can optimize air flow across the dimple in multiple directions, provide added flexibility in dimple count and placement, and meanwhile create a unique aesthetic appearance on the golf ball surface.

BACKGROUND OF THE INVENTION

Golf balls generally include a spherical outer surface with a plurality of dimples formed therein. Dimples improve the aerodynamic characteristics of a golf ball, and therefore, golf ball manufacturers continue to search for unique dimple patterns, shapes, volumes, and cross-sections which can maximize the aerodynamic performance of a golf ball.

Golf ball dimples are often spherical dimples, i.e., dimples having a circular plan shape and a profile based on a spherical function. Unfortunately, the circular perimeters of spherical dimples generally limit dimple count and packing efficiency within the golf ball outer surface. And circular plan-shaped dimples cannot be tessellated or tiled on the surface of a ball with narrow uniform gaps. Even with ideal packing, triangular pieces of land area remain where three dimples come together. Among other things, this can cause inconsistent turning angles of the airflow entering the dimples.

Although golf ball manufacturers have previously explored using non-spherical dimple designs to overcome the limits of spherical dimples, there remains a need to develop uniquely configured non-spherical dimples that can optimize directional air flow across the dimple in multiple directions and meanwhile provide improved flexibility regarding dimple count, placement and visual appearance of the dimples in the finished golf ball. Golf balls of the invention address and fill these needs and yet are desirably producible cost effectively within already existing manufacturing processes without sacrificing the benefits of circular dimples in golf ball constructions.

SUMMARY OF THE INVENTION

According to an embodiment of the present disclosure, a golf ball is disclosed. The golf ball includes a generally spherical surface and a plurality of dimples separated by a land area formed on the surface. The plurality of dimples includes a plurality of non-spherical dimples each having a non-axially symmetric plan shape, a varying edge angle, and a geometric centroid of the non-axially symmetric plan shape (GC). Each dimple cross-section of each non-spherical dimple consists of two arcs, each arc extending from a defined point of maximum dimple depth to a point at the land area of the golf ball. Each non-spherical dimple is oriented at an orientation angle, $\alpha$, relative to a reference line. The orientation angle $\alpha$ is dependent on the position of the GC on the surface of the golf ball.

In some embodiments, the orientation angle $\alpha_n$ of an $n^{th}$ non-spherical dimple is dependent on the latitudinal angle $\tau_n$ of the GC of the $n^{th}$ non-spherical dimple.

In some embodiments, the orientation angle $\alpha_n$ of an $n^{th}$ non-spherical dimple is dependent on the longitudinal angle $\varphi_n$ of the GC of the $n^{th}$ non-spherical dimple.

In some embodiments, the plurality of non-spherical dimples have an index n and the orientation angle $\alpha$ of each $n^{th}$ non-spherical dimple is dependent on the value of the index n. In some embodiments, the indexing order of the plurality of non-spherical dimples may be based on the latitudinal angle $\tau$ of the GC of each non-spherical dimple. In other embodiments, the indexing order of the plurality of non-spherical dimples may be based on the longitudinal angle $\varphi$ of the GC of each non-spherical dimple.

In some embodiments, for each non-spherical dimple, $\alpha$ is set to equal the latitudinal angle $\tau$ of the GC of the non-spherical dimple.

In some other embodiments, for each non-spherical dimple, $\alpha$ is set to equal the longitudinal angle $\varphi$ of the GC of the non-spherical dimple.

In some embodiments, the orientation angle $\alpha$ is determined relative to a zero angle position, and wherein the zero angle position is the position in which the reference line intersects the GC and an orientation point OP. In some embodiments, the OP may correspond to the point on the land area from the arc having a minimum edge angle. In other embodiments, the OP may correspond to the point on the land area from the arc having a maximum edge angle.

In some embodiments, the orientation angle $\alpha_n$ of an $n^{th}$ non-spherical dimple is dependent on the latitudinal angle $\tau_n$ of the GC of the $n^{th}$ non-spherical dimple and the latitudinal angle $\varphi_n$ of the GC of the $n^{th}$ non-spherical dimple. The orientation angle $\alpha_n$ of an $n^{th}$ non-spherical dimple may be further dependent on the value of an index n for each $n^{th}$ non-spherical dimple. The orientation angle $\alpha_n$ of an $n^{th}$ non-spherical dimple may be further dependent on an initiation factor $\beta$.

In some embodiments, the orientation angle $\alpha_n$ of an $n^{th}$ non-spherical dimple is determined based on the following equation(s):

$$\alpha_1=(\tau_1\times\beta+\varphi_1)\mathrm{mod}(360)$$

$$\alpha_n=(\tau_n\times\alpha_{n-1}+\varphi_n)\mathrm{mod}(360)\text{ for }n\geq 2.$$

In some other embodiments, the orientation angle $\alpha_n$ of an $n^{th}$ non-spherical dimple is determined based on the following equation(s):

$$\alpha_1=(\varphi_1\times\beta+\tau_1)\mathrm{mod}(360)$$

$$\alpha_n=(\varphi_n\times\alpha_{n-1}+\tau_n)\mathrm{mod}(360)\text{ for }n\geq 2.$$

In some embodiments, every point on the perimeter of the non-spherical dimple is located at a radial angle, $\theta$, about a unit circle, where $0\leq\theta\leq 2\pi$, and the edge angle value of the non-spherical dimple at any given point on the perimeter is defined by the solution of an edge angle function $f(\theta)$, wherein $f(\theta)$ is a non-periodic continuous, differentiable function.

DETAILED DESCRIPTION

Figure 1A:
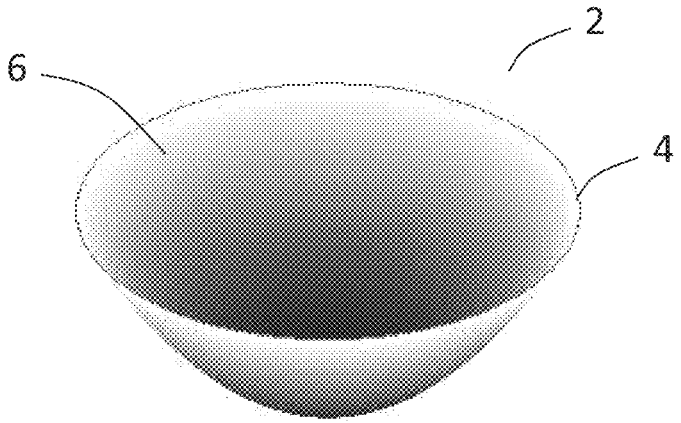
FIG. 1A (Prior Art)
FIG. 1A illustrates a comparative conventional spherical dimple.

Advantageously, golf balls of the invention incorporate improved non-spherical dimples that are uniquely configured to optimize directional flow across the dimple in multiple directions and meanwhile provide added flexibility in both dimple arrangement, count and in creating a visually distinguishable appearance on the golf ball surface due at least in part to the inventive dimple construction and placement thereof within the finished golf ball's outer surface.

In one embodiment, a golf ball of the invention has a generally spherical surface and comprising a plurality of dimples separated by a land area formed on the ball surface, wherein the plurality of dimples includes at least one non-spherical dimple having a non-axially symmetric plan shape and a defined point of maximum dimple depth, wherein: (i) each dimple cross-section of the non-spherical dimple consists of two arcs, each arc extending from the defined point of maximum dimple depth to a point at the land area of the golf ball; and (ii) every point on the perimeter of the non-spherical dimple is located at a radial angle, θ, about a unit circle, where $0 \le \theta \le 2\pi$, and the edge angle value of the non-spherical dimple at any given point on the perimeter is defined by the solution of an edge angle function $f(\theta)$, wherein $f(\theta)$ is a non-periodic, continuous, differentiable function definable at all points θ and $0 \le \theta \le 2\pi$ and inherently satisfy the condition $f(0)=f(2\pi)$. The resulting dimple maintains continual tangency about its surface and has one distinct maximum dimple depth. Continual tangency means the surface will remain smooth with no distinct edges on the dimple surface, and no steps at the dimple edge.

The deepest point on the surface of the dimple is defined as follows. An infinite number of ball radii extend from the centroid of the ball through any point on the dimple surface and through a corresponding point on the phantom surface of the golf ball. The deepest point on the dimple surface is the point where the distance from the centroid to the point on the dimple surface has the minimum value. The maximum dimple depth is the distance from the deepest point on the dimple surface to the phantom surface of the ball along a ball radius.

Furthermore, the term "non-axially symmetric", as used herein, means that the dimple perimeter is not axially symmetric about an axis connecting the centroid of the dimple and the center of the golf ball.

Moreover, herein, the term "non-periodic" means that the edge angle function is non-repeating for $0 \le \theta \le 2\pi$.

In one embodiment, each of said non-spherical dimples has a maximum dimple depth of from about 0.005 inches to about 0.020 inches.

In another embodiment, each of said non-spherical dimples has an average edge angle of from about 9 degrees to about 19 degrees. In yet another such embodiment, each of said non-spherical dimples has an average edge angle of from about 10 degrees to about 18 degrees. In still another such embodiment, each of said non-spherical dimples has an average edge angle of from about 12.5 degrees to about 15.5 degrees. In another particular embodiment, the difference between the maximum edge angle and the average of the edge angles of all of the dimple profiles of a single dimple of the present invention is 1.50 degrees or less.

Figure 6:
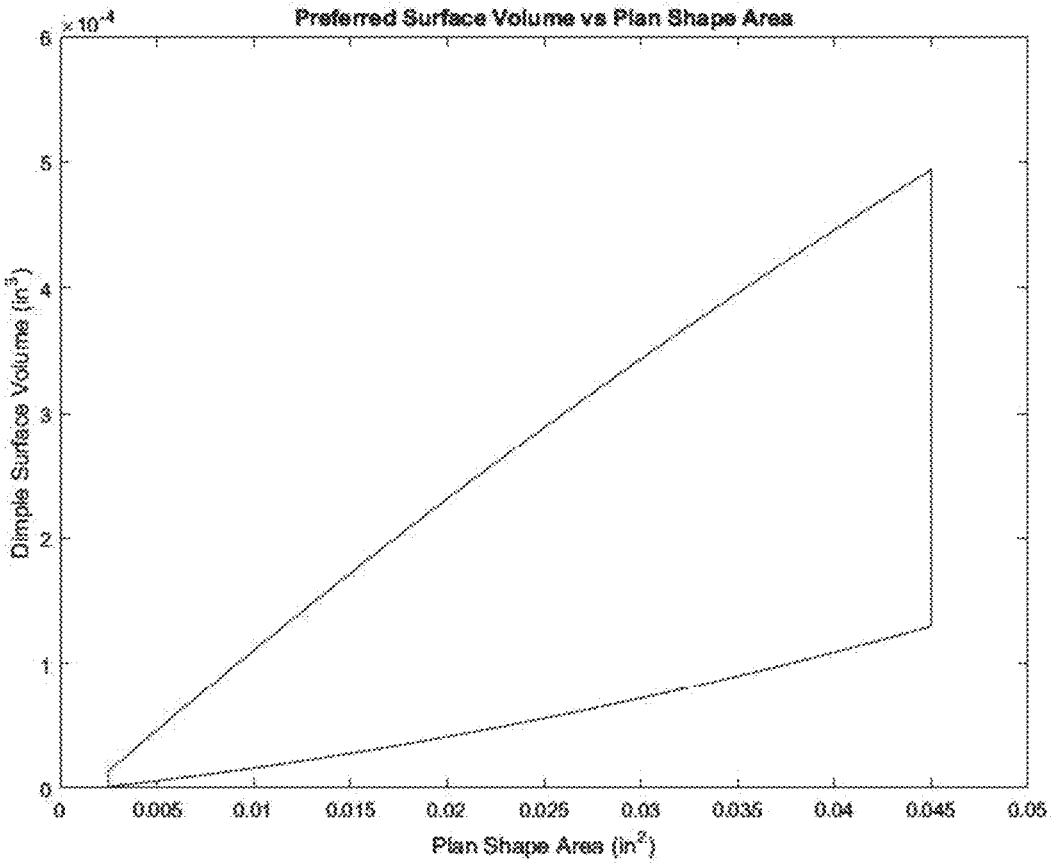
FIG. 6 is a graphical representation illustrating preferred dimple surface volumes for golf balls produced in accordance with the present invention.

Further, dimples of the present invention have a dimple volume and a plan shape area. By the term "dimple volume," it is meant the total volume encompassed by the dimple surface and the phantom surface of the golf ball. By the term, "plan shape area," it is meant the area based on a planar view of the dimple plan shape, such that the viewing plane is normal to an axis connecting the center of the golf ball to the point of the maximum dimple depth. The plan shape area and total dimple volume should fall within the preferred ranges shown in FIG. 6.

In a specific embodiment, each of said non-spherical dimples has a dimple volume $D_v$ such that $V_s1<D_v<V_s2$; wherein $V_s1=0.0300x^2+0.0016x-3.00\times10^{-6}$, and $V_s2=-0.0464x^2+0.0135x-2.00\times10^{-5}$, and x is the dimple's plan shape area.

In one such specific embodiment, x is from about 0.0025 in.$^2$ to about 0.045 in.$^2$. In another such specific embodiment, x is from about 0.0030 in.$^2$ to about 0.040 in.$^2$. In yet another such specific embodiment, x is from about 0.0025 in.$^2$ to about 0.035 in.$^2$. In still another such specific embodiment, x is greater than 0.0035 in.$^2$ and up to about 0.045 in.$^2$.

In one embodiment, the plurality of dimples includes a plurality of said non-spherical dimples, and the plurality of non-spherical dimples includes dimples having at least two different maximum dimple depths. For purposes of the present disclosure, maximum dimple depths are considered different if their values differ by more than 0.0005 inches.

In another embodiment, the plurality of dimples includes a plurality of said non-spherical dimples, and the plurality of non-spherical dimples includes dimples having at least two different average edge angles. For purposes of the present disclosure, average edge angles are considered different if their values differ by 0.25 degrees or greater.

In yet another embodiment, the plurality of dimples includes a plurality of said non-spherical dimples, and the plurality of non-spherical dimples includes dimples having at least two different plan shape areas. For purposes of the present disclosure, plan shape areas are considered different if their values differ by 7% or more.

In one embodiment, the plurality of dimples includes a plurality of non-spherical dimples, and the total dimple volume of all said non-spherical dimples is at least 25% of the total dimple volume. In another embodiment, the plurality of dimples includes a plurality of non-spherical dimples, and the total dimple volume of all said non-spherical dimples is at least 50% of the total dimple volume. In yet another embodiment, the plurality of dimples includes a plurality of non-spherical dimples, and the total dimple volume of all said non-spherical dimples is at least 75% of the total dimple volume. In still another embodiment, the plurality of dimples consists of a plurality of said non-spherical dimples.

Figure 1B:
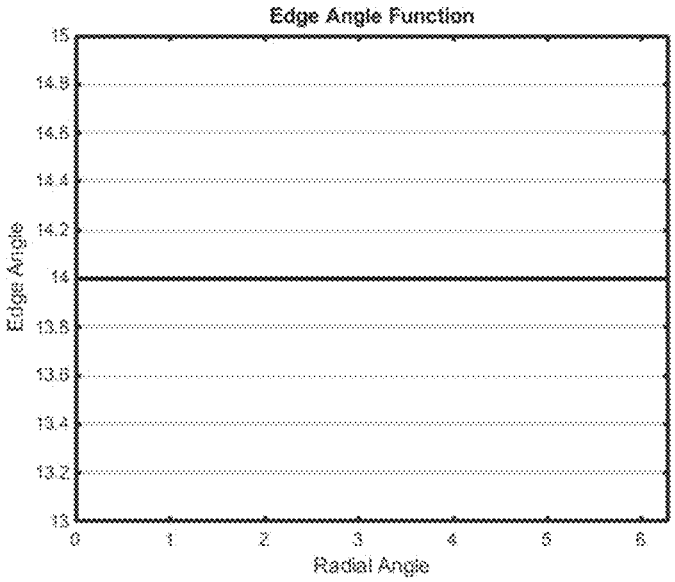
FIG. 1B (Prior Art)
FIG. 1B is graph illustrating the edge angle function for the conventional circular dimple depicted in FIG. 1A in terms of edge angle versus radial angle.
Figure 1C:
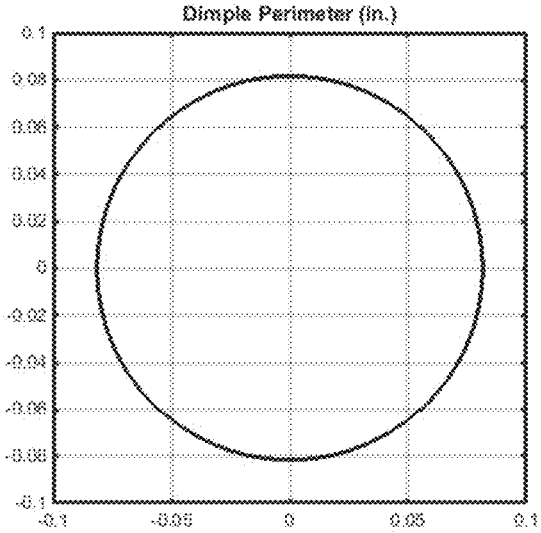
FIG. 1C (Prior Art)
FIG. 1C is a graph depicting the plan shape of the dimple of FIG. 1A.
Figure 2A:
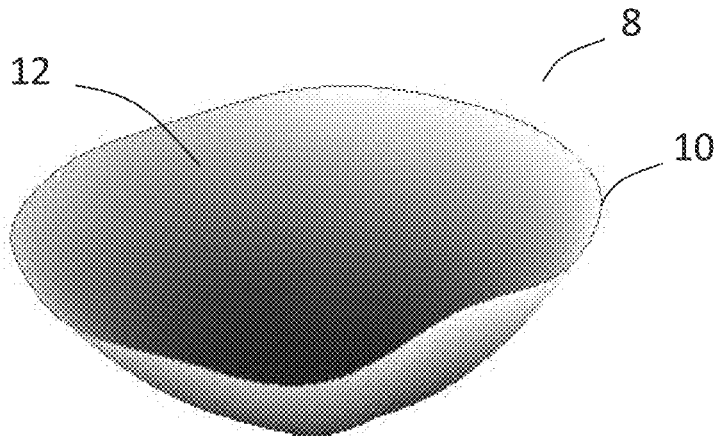
FIG. 2A illustrates an inventive dimple according to one embodiment.
Figure 2B:
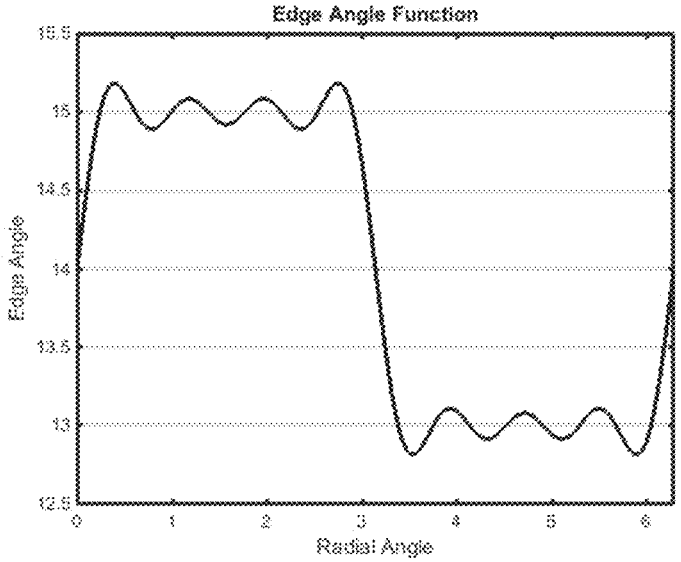
FIG. 2B is graph illustrating the edge angle function for the inventive dimple depicted in FIG. 2A in terms of edge angle versus radial angle.
Figure 2C:
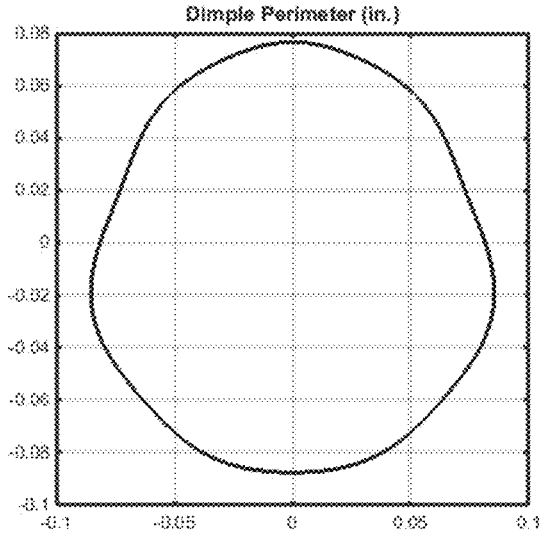
FIG. 2C is a graph depicting the plan shape of the dimple of FIG. 2A.
Figure 3A:
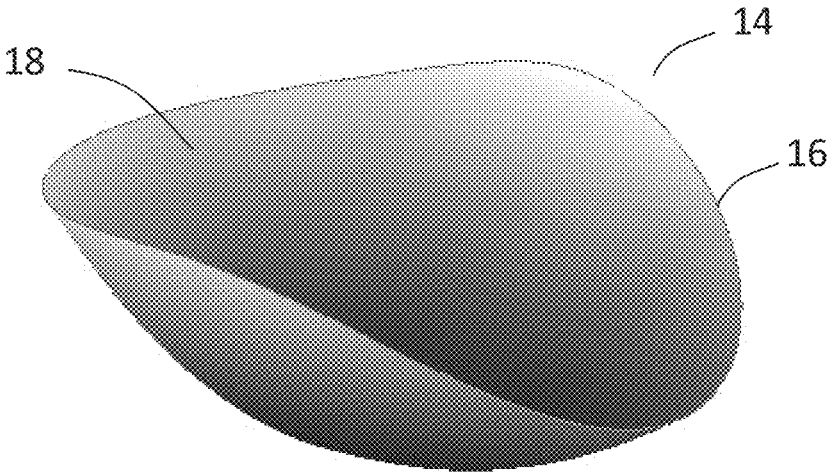
FIG. 3A illustrates an inventive dimple according to another embodiment.
Figure 3B:
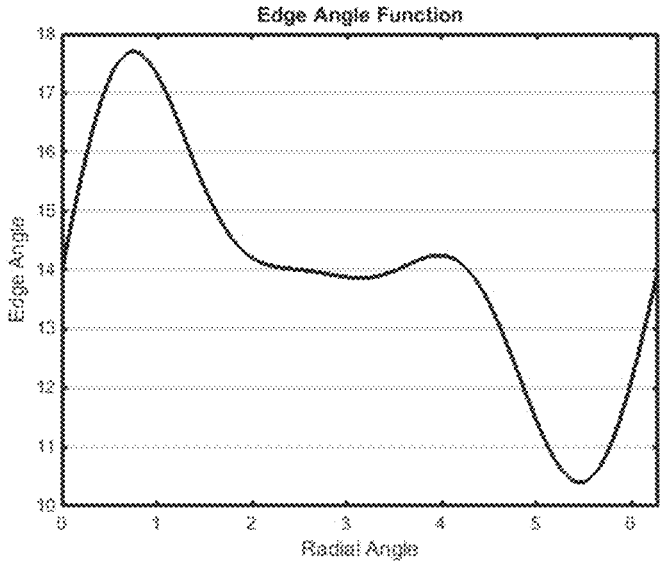
FIG. 3B is graph illustrating the edge angle function for the inventive dimple depicted in FIG. 3A in terms of edge angle versus radial angle.
Figure 3C:
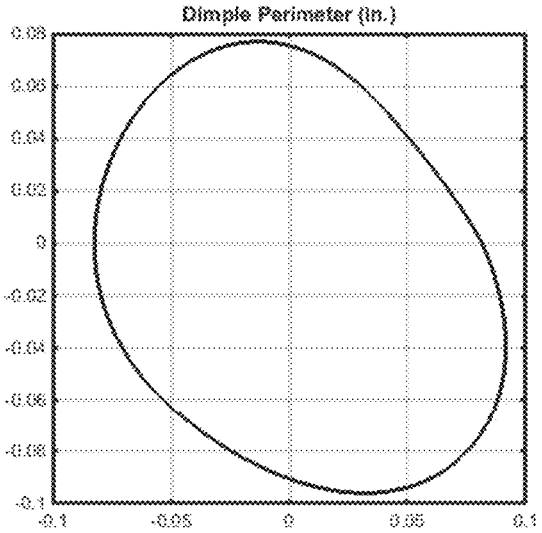
FIG. 3C is a graph depicting the plan shape of the inventive dimple of FIG. 3A.
Figure 4A:
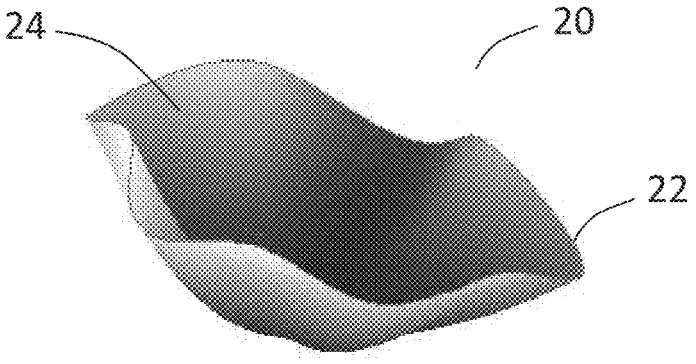
FIG. 4A illustrates an inventive dimple according to yet another embodiment.

FIGS. 2-4 (A-C) illustrate non-limiting examples of resulting inventive non-spherical dimples of golf balls of the invention which may be compared with conventional spherical dimples such as that depicted in FIG. 1(A-C). In this regard, each inventive non-spherical dimple depicted in FIGS. 2A, 3A, and 4A and the conventional spherical dimple depicted in FIG. 1A has an accompanying graph (B), which illustrates the edge angle function for the respective dimple in terms of edge angle versus radial angle, while a corresponding graph (C), illustrates the plan shape of its respective dimple.

Specifically, spherical dimple 2 of FIG. 1A has a conventional perimeter 4 with a circular plan shape and a conventional dimple surface 6 having a single profile shape defined by a spherical function. The edge angle value of spherical dimple 2 is the same at all points on the perimeter, as shown in FIG. 1B.

Figure 8:
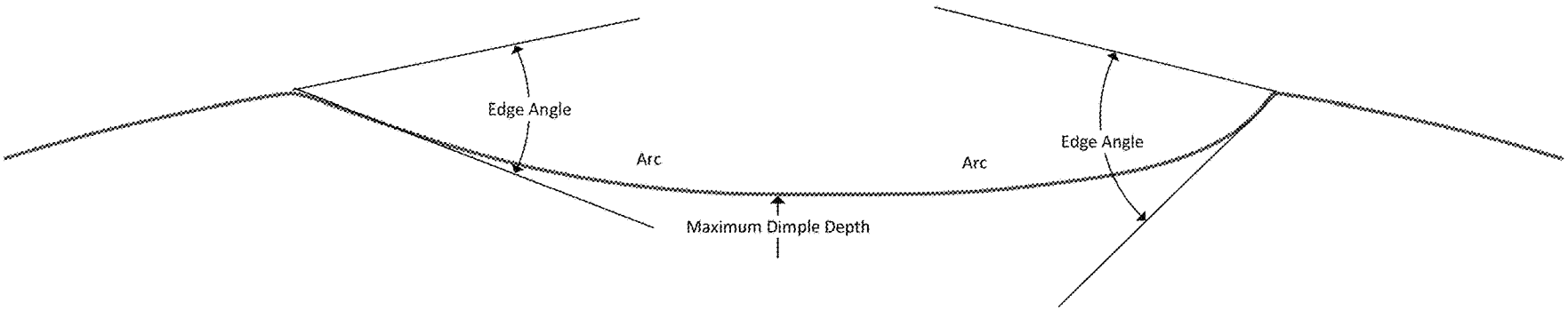
FIG. 8 is a diagram of a profile shape of a dimple having two arcs extending from a defined point of maximum dimple depth to a point at the land area of the golf ball.

In contrast, FIG. 2A depicts an inventive dimple 8 according to one embodiment having perimeter 10 with a non-axially symmetric plan shape and dimple surface 12 having an infinite number of profile shapes each of which consists of two arcs intersecting at the deepest point of the dimple surface. FIG. 8 depicts an example of one such profile shape having two arcs. The edge angle value of the inventive dimple 8 at a given point on the perimeter is determined by the solution to the edge angle function:

$$f(\theta) = 14 + \frac{4}{\pi} \cdot \sin(\theta) + \frac{\sin(3\theta)}{3} + \frac{\sin(5\theta)}{5} + \frac{\sin(7\theta)}{7}$$

which is shown in FIG. 2B.

Furthermore, in FIG. 3A, an inventive dimple 14 according to another embodiment has perimeter 16 and dimple surface 18 wherein the edge angle value of the inventive dimple 14 at a given point on the perimeter is determined by the solution to the edge angle function:

$$f(\theta) = 14 + 5\cos\left(\frac{\theta}{2}\right)^3 \cdot \sin\left(\frac{3}{2}\theta\right) + \frac{\sin\left(\frac{7}{2}\theta\right)}{7}$$

which is shown in FIG. 3B.

Figure 4B:
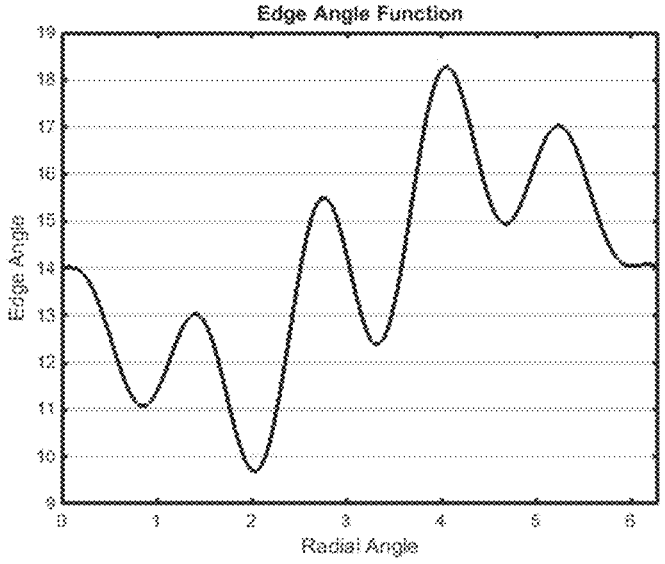
FIG. 4B is graph illustrating the edge angle function for the inventive dimple depicted in FIG. 4A in terms of edge angle versus radial angle.
Figure 4C:
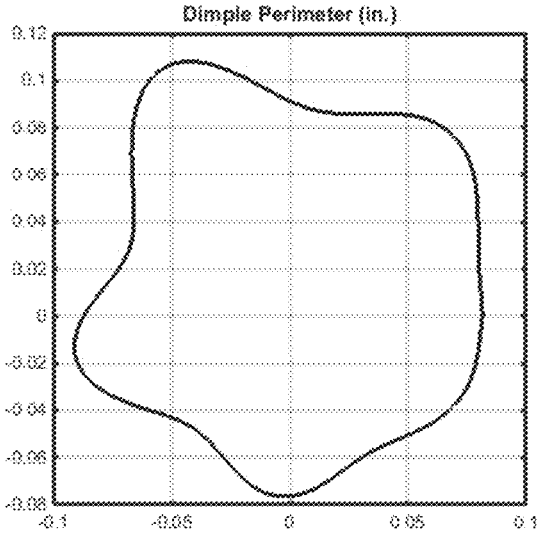
FIG. 4C is a graph depicting the plan shape of the inventive dimple of FIG. 4A.
Figure 5:
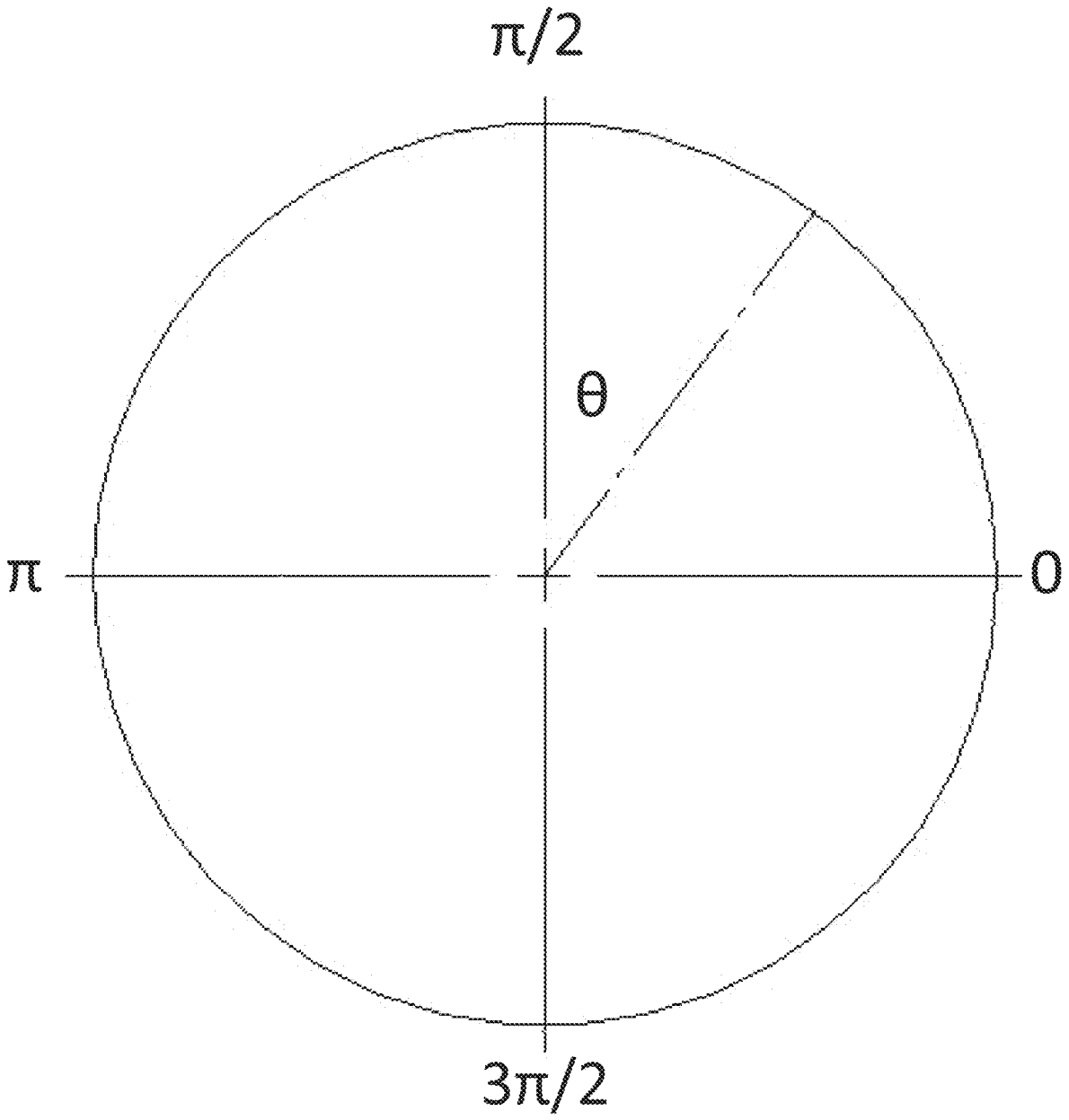
FIG. 5 illustrates angle θ about the unit circle.

Finally, in FIG. 4A, an inventive dimple 20 according to yet another embodiment has perimeter 22 and dimple surface 24 wherein the edge angle value of the inventive dimple 20 at a given point on the perimeter is determined by the solution to the edge angle function:

$$f(\theta) = 14 + \sin(-4.139 \cdot \theta) + \frac{\sin(-1.026 \cdot \theta)}{0.387} + \frac{\sin(5.166 \cdot \theta)}{0.723}$$

which is shown in FIG. 4B.

Accordingly, dimples having a non-circular plan shape are produced that are uniquely configured to optimize directional flow across the dimple in multiple directions and meanwhile provide flexibility in both dimple arrangement, count and in creating a visually distinguishable appearance on the golf ball surface due at least in part to the inventive dimple construction and placement thereof within the finished golf ball's outer surface.

Golf balls of the present invention may further include conventional dimples having any width, depth, depth profile, edge angle, or edge radius and the patterns may include multitudes of dimples having different widths, depths, depth profiles, edge angles, or edge radii.

Since the plan shape of dimple of the present invention is non-circular, the inventive dimples have an effective dimple diameter which is twice the average radial dimension of the set of points defining the plan shape from the plan shape centroid. In one embodiment, dimples according to the present invention have an effective dimple diameter within a range of about 0.005 inches to about 0.300 inches. In another embodiment, the dimples have an effective dimple diameter of about 0.020 inches to about 0.250 inches. In still another embodiment, the dimples have an effective dimple diameter of about 0.100 inches to about 0.225 inches. In yet another embodiment, the dimples have an effective dimple diameter of about 0.125 inches to about 0.200 inches.

Figure 7:
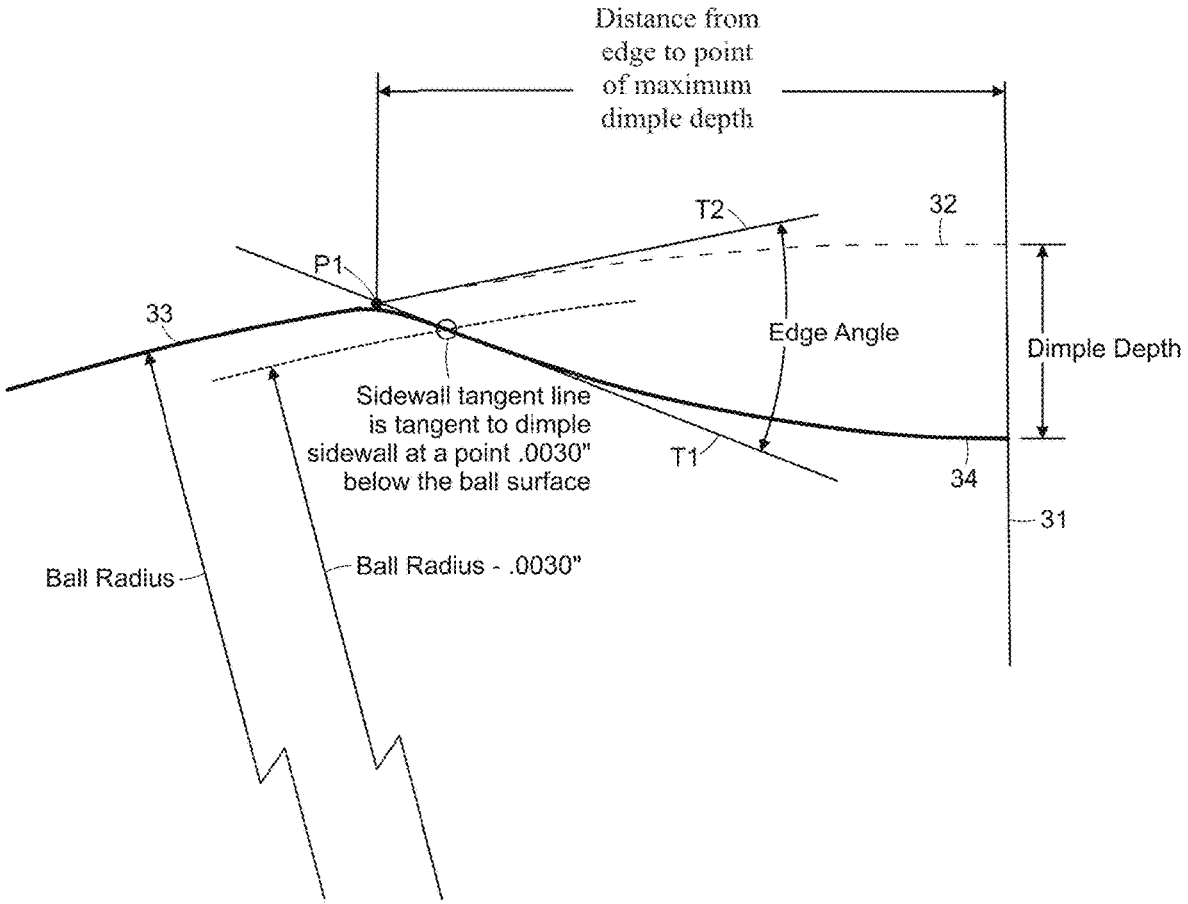
FIG. 7 is a schematic diagram illustrating a method for measuring the edge angle of a dimple of the invention in a golf ball of the invention.

For purposes of the present disclosure, edge angle measurements are determined on finished golf balls. Generally, it may be difficult to measure an edge angle due to the indistinct nature of the boundary dividing the dimple from the ball's undisturbed land surface. Due to the effect of coatings on the golf ball surface and/or the dimple design itself, the junction between the land surface and the dimple is typically not a sharp corner and is therefore indistinct. This can make the measurement of properties such as edge angle and dimple diameter, somewhat ambiguous. To resolve this problem, edge angle on a finished golf ball is measured as follows, in reference to FIG. 7. FIG. 7 shows a portion of a dimple profile 34 extending from the point of maximum dimple depth to the ball's undisturbed land surface 33. Axis 31 is the axis which includes the centroid of the ball and the point of maximum dimple depth. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter at this particular dimple cross-section is the distance between P1 and its equivalent point at the opposite end of the dimple profile.

It is envisioned that golf balls of the invention may otherwise have any known construction and include any known number of layers and be comprised of any known polymeric composition(s). Golf balls of the invention may solely include inventive dimples or alternatively further include conventional circular and/or non-circular dimples in order to target desired playing characteristics.

Golf balls of the present disclosure may include a plurality of dimples separated by a land area formed on the ball surface, the plurality of dimples including a plurality of non-spherical dimples each having a non-axially symmetric plan shape and a varying edge angle according to the disclosed embodiments. Each dimple cross-section of each non-spherical dimple may consist of two arcs, each arc extending from a defined point of maximum dimple depth to a point at the land area of the golf ball. In some embodiments, the plurality of non-spherical dimples may be arranged on the surface of a golf ball such that each non-spherical dimple has a pre-determined orientation angle relative to an established zero angle position.

With spherical dimples, the orientation of the dimple on the golf ball surface is not relevant due to the symmetry of a circle. Non-spherical dimples having non-symmetrical plan shapes, on the other hand, can be oriented at different angles relative to each other on the surface of a golf ball, thereby affecting aerodynamic performance. If all of a plurality of non-spherical, variable edge angle dimples are oriented in the same direction, a detrimental bias of the airflow over the surface of the golf ball may be introduced, which may in turn result in a decrease in aerodynamic efficiency, a decrease in symmetric flight performance, or both. Accordingly, the present disclosure further includes golf balls that vary the angular orientation of each non-spherical dimple to thereby enhance their possible aerodynamic benefits while mitigating potential performance sacrifices.

Figure 9:
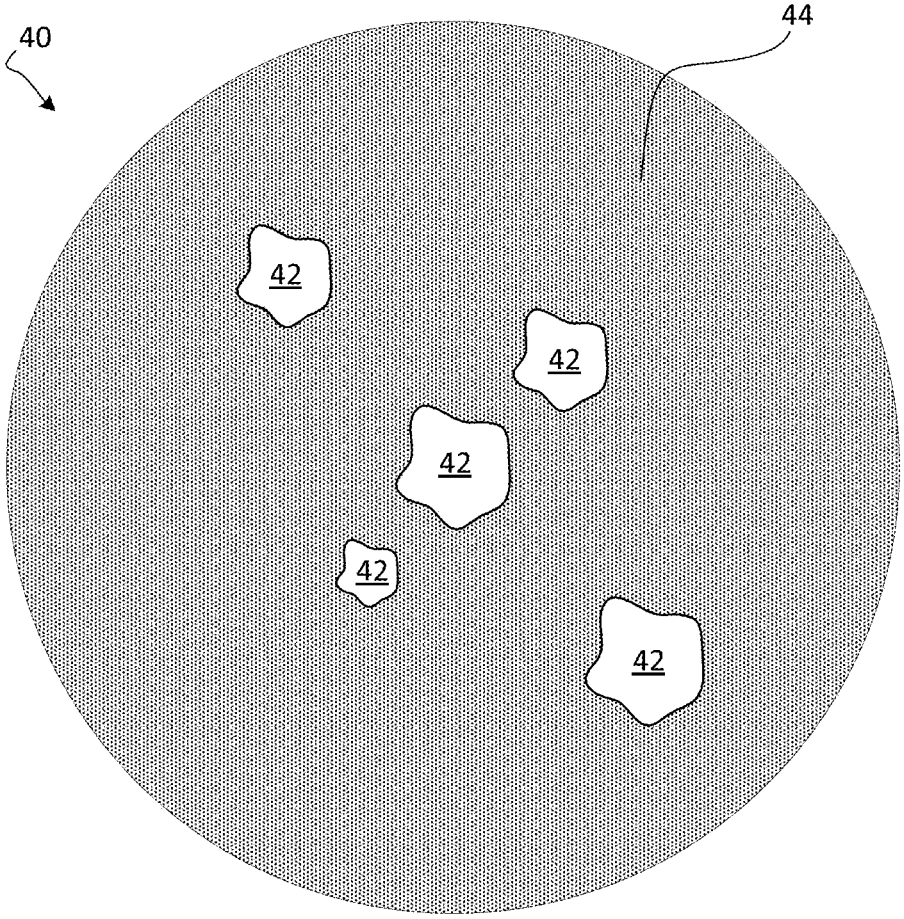
FIG. 9 is a depiction of a golf ball, highlighting a selection of non-spherical dimples on the surface of the golf ball, each of the depicted dimples having the same orientation angle.

FIG. 9 is an example of a golf ball 40 having a plurality of dimples 42 formed on a spherical surface 44. In order to simplify the description, FIG. 9 depicts only five dimples 42. However, it should be understood that the shaded region of the golf ball 40 may include additional dimples, including additional dimples having the same and/or similar shapes and configurations to the dimples 42. Each of the dimples 42 is non-spherical, resulting in a non-axially symmetric plan shape. Dimples with a non-axially symmetric plan shape may also be referred to herein as irregular dimples. For example, each dimple 42 may have a configuration based on the dimple 20 as depicted and described in relation to FIGS. 4A-4C. The dimples 42 may thereby have the same perimeter shape, but may have different sizes as shown.

The golf ball 40 includes dimples 42 on the spherical surface 44 separated by land area immediately adjacent the perimeters of each dimple 42. In the embodiment of FIG. 9, the dimples 42 are all arranged with the same orientation angle $\alpha$. The orientation angle $\alpha$ is a measure of the orientation of an irregular dimple relative to a zero angle position. Since each of the dimples 42 have the same shape, they each can have the same zero angle position.

Figure 10:
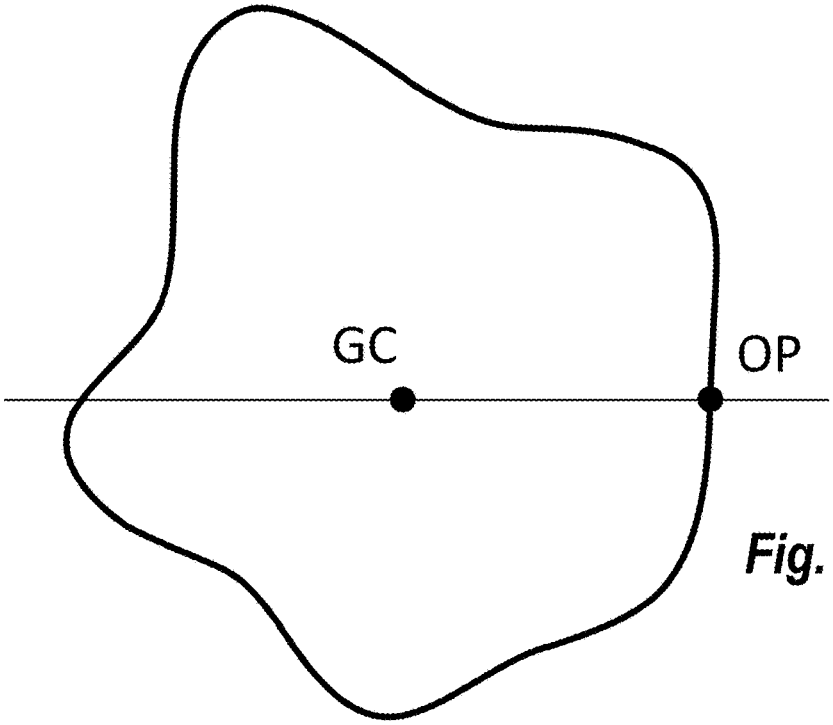
FIG. 10 is a plan view of a non-spherical dimple with an orientation point at a zero angle position.

FIG. 10 depicts a dimple 42 at a zero angle position. The dimple 42 includes a geometric center of the plan shape (GC). It should be understood that FIG. 10 is illustrative of the concept and does not necessarily point to the exact GC of the dimple 42. The dimple 42 further includes an orientation point (OP). In an exemplary embodiment, the zero angle position is determined as a horizontal line through the GC and the OP. The horizontal line in this example is a reference line for use in determining the orientation angle $\alpha$. The zero angle position is relative and can be determined using other methods.

According to disclosed embodiments, the OP may be a predetermined point along the perimeter of the dimple 42. For example, the OP may be a point corresponding to the point on the land area from the arc having a minimum edge angle or maximum edge angle, minimum effective radius, maximum effective radius, or other identifiable point on the perimeter. If a minimum or maximum parameter is chosen for the OP and the dimple includes more than one point that qualifies as the minimum or maximum, either point may be selected or a further limitation may be used to select between the multiple options.

Figure 11:
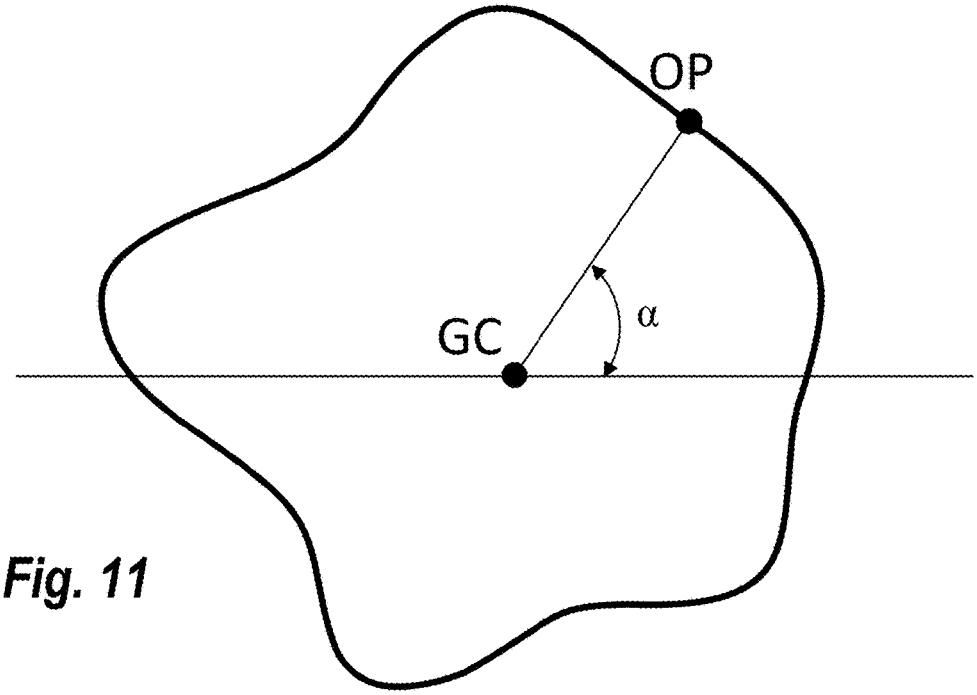
FIG. 11 is a plan view of the non-spherical dimple of FIG. 10, rotated to a non-zero angular orientation.

FIG. 11 depicts the dimple 42 with a non-zero orientation angle $\alpha$. The orientation angle $\alpha$ is the angle between the line from the GC to the OP and the reference line (in this case the horizontal line connecting the GC to the OP in the zero angle position). The reference line may be further used to maintain the orientation angle $\alpha$ on the surface of the golf ball by keeping all of the reference lines for all of the dimples 42 parallel (e.g., parallel to the horizontal). For example, in the example of FIG. 9, all of the dimples 42 have the same orientation angle $\alpha$ by keeping all of the reference lines parallel relative to each other.

Figure 12:
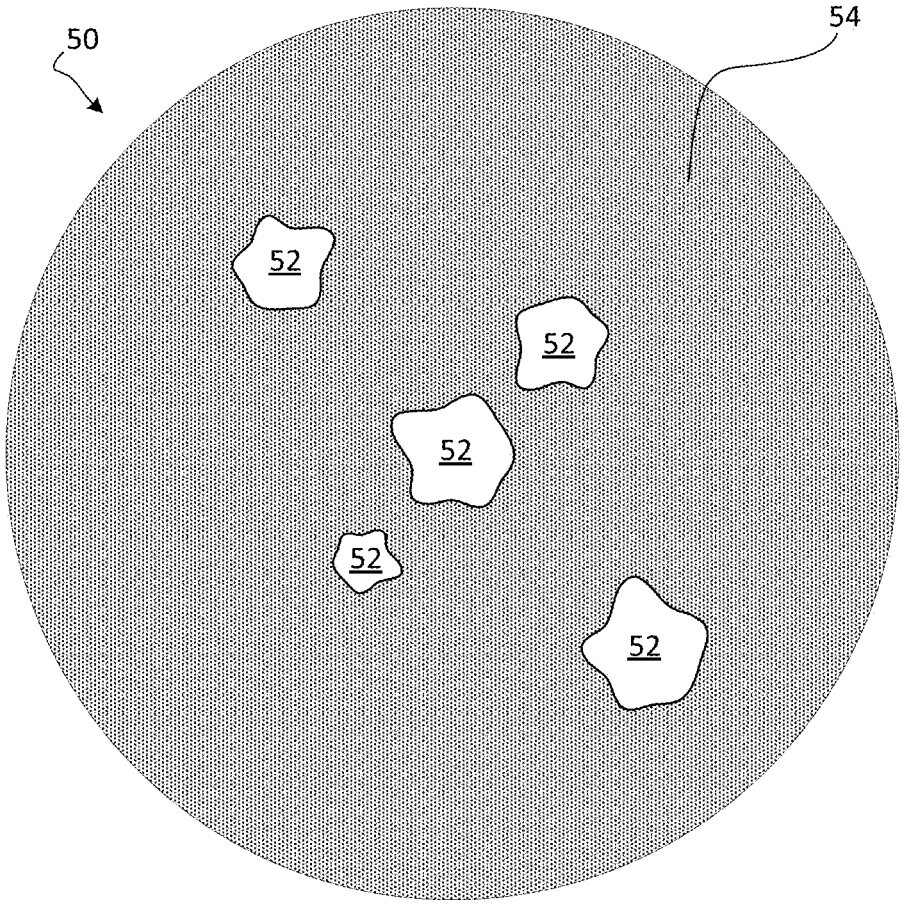
FIG. 12 is a depiction of a golf ball, highlighting a selection of non-spherical dimples of the surface of the golf ball, each of the depicted dimples having a different orientation angle.

According to disclosed embodiments, golf balls including a plurality of irregular dimples may be made such that the irregular dimples each have a varying orientation angle $\alpha$ in order to alter the aerodynamic effect of the irregular dimples. FIG. 12 is a depiction of a golf ball 50 having a plurality of dimples 52 on a spherical surface 54. The plurality of dimples 52 correspond to the dimples 42 of the golf ball 40, with the exception that the orientation angle $\alpha$ of the dimples 52 has been varied such that the dimples 52 are each oriented differently on the surface 54.

Figure 13:
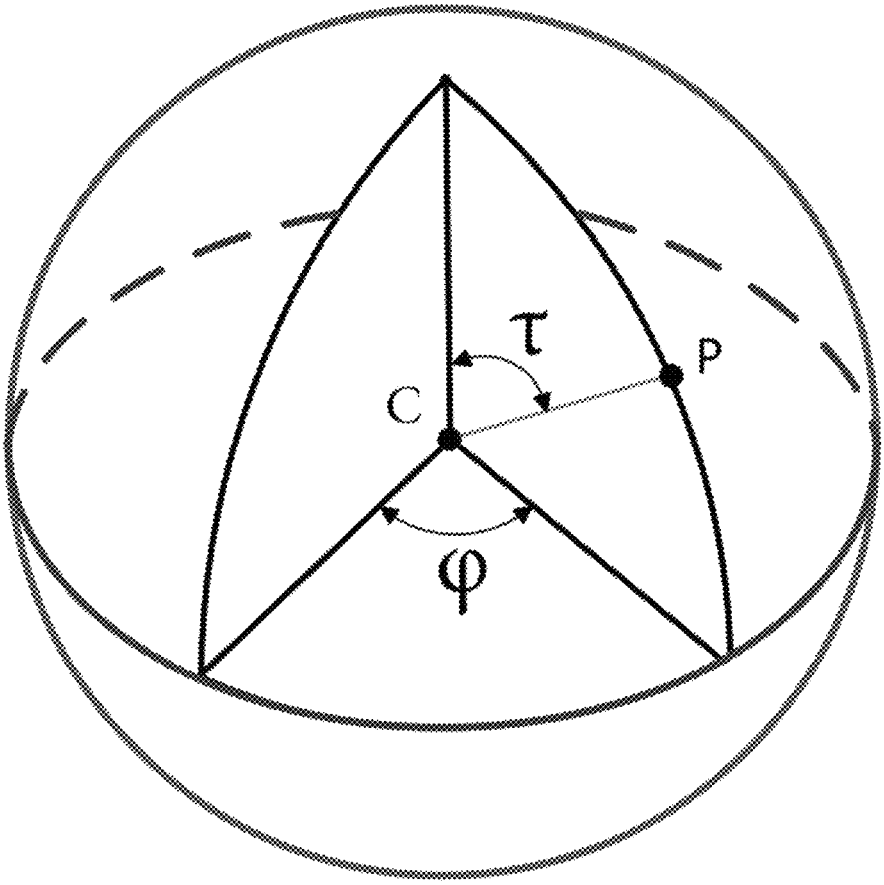
FIG. 13 is a diagram of a golf ball, depicting longitudinal and latitudinal angles of a given point P on a surface of the golf ball.

Disclosed embodiments may include a variety of methods for varying the orientation angle $\alpha$ for a plurality of irregular dimples on a golf ball. In some embodiments, the orientation angle $\alpha$ may depend on the position of the dimple on the surface of the golf ball. For example, in an exemplary method, the position for each dimple on the golf ball may be predetermined prior to determining the orientation angle $\alpha$ for each dimple. Each position may have associated values that identify the position, such as latitudinal angle $\tau$ and longitudinal angle $\varphi$. FIG. 13 is a diagram illustrating latitudinal angle $\tau$ and longitudinal angle $\varphi$ of a given point P on the surface of a sphere having a center C. The latitudinal angle $\tau$ and longitudinal angle $\varphi$ may be expressed in degrees relative to selected reference (e.g., a pole and/or point on a great circle). The position of a dimple on a surface of a golf ball may thus be expressed as the latitudinal and longitudinal angles of the geometric center GC of the plan shape of the irregular dimple.

With the predetermined position of each GC of each irregular dimple on a given golf ball, a method may further include using at least one position value (e.g., $\tau$ and/or $\varphi$) to determine the orientation angle $\alpha_n$ for each $n^{th}$ irregular dimple. The method may include using an orientation angle equation that depends on $\tau$ and/or $\varphi$. In one example, the orientation angle $\alpha_n$ is determined based on the following Orientation Angle equation(s):

$$\alpha_1=(\tau_1\times\beta+\varphi_1)\text{mod}(360)$$

$$\alpha_n=(\tau_n\times\alpha_{n-1}+\varphi_n)\text{mod}(360) \text{ for } n\geq 2$$

where n is the identifying index of the irregular dimple, $\tau$ is the latitudinal angle of the GC in degrees, $\varphi$ is the longitudinal angle of the GC in degrees, and $\beta$ is the initiation factor. The operator "mod" is a modulo operator. A modulo operator provides the remainder of A divided by B when presented as (A)mod(B).

For the example equation(s) above, the orientation angle $\alpha_n$ of a given irregular dimple is based on the index order of the dimple among all of the dimples on the golf ball. For example, if a golf ball has 300 irregular dimples to be individually oriented at an orientation angle $\alpha$, the dimples need to be indexed to give each dimple a number n from 1-300 to determine the order in which the orientation angle is determined. There are many examples of methods for determining an indexing order of dimples. For example, the indexing order may be based on the latitudinal angle $\tau$ or the longitudinal angle $\varphi$ of the GC of the dimple. If either of these parameters are the same for more than one dimple (e.g., two dimples have the same latitudinal angle $\tau$), a second parameter may be used to differentiate and index the dimples. Other examples of parameters for use in determining an indexing order may include dimple size, dimple depth, dimple volume, among other possibilities.

After the indexing order has been determined, the orientation angle $\alpha_n$ may be determined for each irregular dimple that has an index n. The orientation angle $\alpha_1$ for the dimple having an index n of 1 may be determined using:

$$\alpha_1=(\tau_1\times\beta+\varphi_1)\text{mod}(360)$$

As shown, $\alpha_1$ depends on the latitudinal angle $\tau$ and the longitudinal angle $\varphi$ of the GC of the dimple, as well as well as an initiation factor $\beta$. The initiation factor $\beta$ may be a selected constant that introduces an additional variable to produce different golf balls that otherwise have the same dimples at the same locations. As a result, the initiation factor $\beta$ may be a tool to refine golf ball performance by enabling modification to orientation angles where other variables are the same.

After $\alpha_1$ is determined, the orientation angle $\alpha_n$ for the remaining indexed dimples may be determined using:

$$\alpha_n=(\tau_x\times\alpha_{n-1}+\varphi_n)\text{mod})(360)$$

The orientation angle $\alpha_n$ for each $n^{th}$ dimple thereby depends on the position of the GC of the dimple and the orientation angle of the dimples that precede in the indexing order. As a result, a golf ball having a plurality of irregular dimples may be adapted such that the orientation of the irregular dimples varies across the surface of the golf ball relative to a common reference (e.g., relative to parallel horizontal reference lines through the GC of each dimple).

The following tables include examples to further illustrate a variance in orientation angle depending on the position of the dimple on the golf ball, the indexing order of the dimple, and/or the predetermined initiation factor.

In Table 1, the orientation angle $\alpha_n$ varies based on the latitudinal angle $\tau$ with other variables remaining constant.

TABLE 1

Variation of $\alpha_n$ based on $\tau_n$

| n | $\tau_n$ | $\varphi_n$ | $\beta$ | $\alpha_n$ |
|---|---|---|---|---|
| 1 | 15° | 275° | 6.4 | 11° |
| 1 | 35° | 275° | 6.4 | 139° |
| 1 | 55° | 275° | 6.4 | 267° |
| 1 | 75° | 275° | 6.4 | 35° |

In Table 2, the orientation angle $\alpha_n$ varies based on the longitudinal angle $\varphi$ with other variables remaining constant.

TABLE 2

Variation of $\alpha_n$ based on $\varphi_n$

| n | $\tau_n$ | $\varphi_n$ | $\beta$ | $\alpha_n$ |
|---|---|---|---|---|
| 1 | 35° | 50° | 6.4 | 274° |
| 1 | 35° | 125° | 6.4 | 349° |
| 1 | 35° | 200° | 6.4 | 64° |
| 1 | 35° | 275° | 6.4 | 139° |

In Tables 3 and 4, the orientation angle $\alpha_n$ varies based on the indexing order n with other variables remaining constant. Table 3 shows a first indexing order of dimples A, B, C, D and the resulting orientation angle $\alpha_n$. Table 4 shows that if the indexing order of those same dimples is changed (e.g., an order of B, C, A, D), the orientation angle for each of the dimples is different than in Table 3.

| n | Dimple Identification | $\tau_n$ | $\varphi_n$ | $\beta$ | $\alpha_n$ |
|---|---|---|---|---|---|
| 1 | A | 15° | 275° | 6.4 | 335° |
| 2 | B | 25° | 70° | — | 75° |
| 3 | C | 30° | 145° | — | 105° |
| 4 | D | 65° | 315° | — | 20° |

| n | Dimple Identification | $\tau_n$ | $\varphi_n$ | $\beta$ | $\alpha_n$ |
|---|---|---|---|---|---|
| 1 | B | 25° | 70° | 6.4 | 113° |
| 2 | C | 30° | 145° | — | 215° |
| 3 | A | 35° | 275° | — | 100° |
| 4 | D | 65° | 315° | — | 245° |

Tables 3 and 4—Variation of $\alpha_n$ depending on how the dimples are indexed n In Table 5, the orientation angle $\alpha_n$ varies based on the initiation factor $\beta$.

TABLE 5

Variation of $\alpha_n$ depending on the predetermined initiation factor $\beta$.

| n | $\tau_n$ | $\varphi_n$ | $\beta$ | $\alpha_n$ |
|---|---|---|---|---|
| 1 | 35° | 275° | 6.4 | 139° |
| 1 | 35° | 275° | 38.7 | 189.5° |
| 1 | 35° | 275° | 101.9 | 241.5° |
| 1 | 35° | 275° | 497.2 | 37° |

Table 6 shows a further example to show how orientation angle varies over a consecutive sequence of dimples having different latitudinal and longitudinal positions.

TABLE 6

Variation of $\alpha_n$ for a sequence of dimples at different positions on a golf ball

| n | $\tau_n$ | $\varphi_n$ | $\beta$ | $\alpha_n$ |
|---|---|---|---|---|
| 1 | 35° | 275° | 6.4 | 139° |
| 2 | 10° | 60° | — | 10° |
| 3 | 70° | 130° | — | 110° |
| 4 | 40° | 215° | — | 295° |

The disclosed Orientation Angle equation(s) should be understood to be exemplary and that other equations may be used to determine orientation angles. For example, the following Orientation Angle equations(s) may be used:

$$\alpha_1=(\varphi_1\times\beta+\tau_1)\text{mod}(360)$$

$$\alpha_n=(\varphi_n\times\alpha_{n-1}+\tau_n)\text{mod}(360) \text{ for } n\geq 2$$

In still other embodiments, the orientation angle may be set to be equal to another parameter associated with the irregular dimple. For example, $\alpha$ may be set to be equal to the latitudinal angle $\tau$ of the GC of the dimple. In another example, $\alpha$ may be set to be equal to the longitudinal angle $\varphi$ of the GC of the dimple.

The disclosed embodiments include golf balls having a plurality of irregular dimples with varying edge angles and varying angular orientations relative to each other. The disclosed embodiments further include a method for determining angular orientations of a plurality of dimples on a golf ball for use in designing the golf ball for manufacturing. For instance, a method may include determining the position for a plurality of irregular dimples on a golf ball, the positions including latitudinal and longitudinal angles for the GC of each irregular dimple. The method may also include determining an indexing order for the plurality of dimples. The indexing order may be based on one or more parameters, such as the latitudinal and/or longitudinal angle of the GC of each irregular dimple. The method may further include selecting an initiation factor for the orientation angle determination. The method may also include determining the orientation angle for the plurality of irregular dimples based on the latitudinal angle, the longitudinal angle, the indexing order, and the initiation factor. In some embodiments, the orientation angle further depends on the orientation angle of dimples preceding the dimple in the indexing order.

The disclosed embodiments provide golf balls having customizable aerodynamic performance through the use of irregular dimples and variation in the orientation of the irregular dimples. Disclosed embodiments having irregular dimples include, for example, the dimples described in relation to the disclosed figures (e.g., FIGS. 3A-3C, 4A-4C), as well as other embodiments of irregular dimples within the scope of the description.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball having a generally spherical surface and comprising a plurality of dimples separated by a land area formed on the surface, wherein the plurality of dimples includes a plurality of non-spherical dimples each having a non-axially symmetric plan shape, a varying edge angle, and a geometric centroid of the non-axially symmetric plan shape (GC), wherein:

each dimple cross-section of each non-spherical dimple consists of two arcs, each arc extending from a defined point of maximum dimple depth to a point at the land area of the golf ball;

wherein each non-spherical dimple is oriented at an orientation angle, $\alpha$, relative to a reference line, and wherein the orientation angle $\alpha$ is dependent on the position of the GC on the surface of the golf ball.

2. The golf ball of claim 1, wherein the orientation angle $\alpha_n$ of an $n^{th}$ non-spherical dimple is dependent on the latitudinal angle $\tau_n$ of the GC of the $n^{th}$ non-spherical dimple.

3. The golf ball of claim 1, wherein the orientation angle $\alpha_n$ of an $n^{th}$ non-spherical dimple is dependent on the longitudinal angle $\varphi_n$ of the GC of the $n^{th}$ non-spherical dimple.

4. The golf ball of claim 1, wherein the plurality of non-spherical dimples have an index n and the orientation angle $\alpha$ of each $n^{th}$ non-spherical dimple is dependent on the value of the index n.

5. The golf ball of claim 4, wherein the indexing order of the plurality of non-spherical dimples is based on the latitudinal angle $\tau$ of the GC of each non-spherical dimple.

6. The golf ball of claim 4, wherein the indexing order of the plurality of non-spherical dimples is based on the longitudinal angle $\varphi$ of the GC of each non-spherical dimple.

7. The golf ball of claim 1, wherein, for each non-spherical dimple, $\alpha$ is set to equal the latitudinal angle $\tau$ of the GC of the non-spherical dimple.

8. The golf ball of claim 1, wherein, for each non-spherical dimple, $\alpha$ is set to equal the longitudinal angle $\varphi$ of the GC of the non-spherical dimple.

9. The golf ball of claim 1, wherein the orientation angle $\alpha$ is determined relative to a zero angle position, and wherein the zero angle position is the position in which the reference line intersects the GC and an orientation point OP.

10. The golf ball of claim 9, wherein the OP corresponds to the point on the land area from the arc having a minimum edge angle.

11. The golf ball of claim 9, wherein the OP corresponds to the point on the land area from the arc having a maximum edge angle.

12. The golf ball of claim 1, wherein the orientation angle $\alpha_n$ of an $n^{th}$ non-spherical dimple is dependent on the latitudinal angle $\tau_n$ of the GC of the $n^{th}$ non-spherical dimple and the latitudinal angle $\varphi_n$ of the GC of the $n^{th}$ non-spherical dimple.

13. The golf ball of claim 12, wherein the orientation angle $\alpha_n$ of an $n^{th}$ non-spherical dimple is further dependent on the value of an index n for each $n^{th}$ non-spherical dimple.

14. The golf ball of claim 13, wherein the orientation angle $\alpha_n$ of an $n^{th}$ non-spherical dimple is further dependent on an initiation factor $\beta$.

15. The golf ball of claim 14, wherein the orientation angle $\alpha_n$ of an $n^{th}$ non-spherical dimple is determined based on the following equation(s):

$$\alpha_1=(\tau_1\times\beta+\varphi_1)\mathrm{mod}(360)$$

$$\alpha_n=(\tau_n\times\alpha_{n-1}+\varphi_n)\mathrm{mod}(360) \text{ for } n\geq 2.$$

16. The golf ball of claim 14, wherein the orientation angle $\alpha_n$ of an $n^{th}$ non-spherical dimple is determined based on the following equation(s):

$$\alpha_1=(\varphi_1\times\beta+\tau_1)\mathrm{mod}(360)$$

$$\alpha_n=(\varphi_n\times\alpha_{n-1}+\tau_n)\mathrm{mod}(360) \text{ for } n\geq 2.$$

17. The golf ball of claim 1, wherein every point on the perimeter of the non-spherical dimple is located at a radial angle, $\theta$, about a unit circle, where $0\leq\theta\leq 2\pi$, and the edge angle value of the non-spherical dimple at any given point on the perimeter is defined by the solution of an edge angle function $f(\theta)$, wherein $f(\theta)$ is a non-periodic continuous, differentiable function.

* * * * *